US006060980A

United States Patent [19]

Bedol

[11] Patent Number: 6,060,980

[45] Date of Patent: May 9, 2000

[54] APPOINTMENT TIMER

[76] Inventor: Mark A. Bedol, 3423 Yankton Ave., Claremont, Calif. 91711

[21] Appl. No.: 09/378,349

[22] Filed: Aug. 20, 1999

[51] Int. Cl.[7] ..... G08B 1/00

[52] U.S. Cl. ..... 340/309.15; 368/108; 368/109; 368/252; 368/223; 368/82; 368/84

[58] Field of Search ..... 340/309.15, 309.3, 340/573.1, 384.71, 825.22; 368/230, 281, 73, 41, 107, 108, 109, 252, 223, 82, 84, 240

[56] References Cited

U.S. PATENT DOCUMENTS

| | | | |
|---|---|---|---|
| 4,373,822 | 2/1983 | Tkac | 368/256 |
| 4,594,007 | 6/1986 | Brandenberg | 368/10 |
| 4,712,923 | 12/1987 | Martin | 368/10 |
| 5,093,760 | 3/1992 | Bedol | 361/392 |
| 5,387,903 | 2/1995 | Cutter et al. | 340/825.31 |

OTHER PUBLICATIONS

"Appointment Reminder" Bearing the Trademark Selectronics™, Model AR119, Distributed by Selectronics N.A., Inc. of Teterboro, New Jersey.

"Appointment Reminder" Bearing the Trademark Day–Timer®, Model AAF–50120, Distributed by Day–Timer®.

*Primary Examiner*—Jeffery A. Hofsass
*Assistant Examiner*—Hung Nguyen

[57] ABSTRACT

A thin appointment timer that can be easily incorporated with the user's organizer ensemble. It includes a housing, a keypad assembly, an indicator assembly, an electronic assembly, and an alarm system. The housing supports the keypad assembly. The keypad assembly includes a touch sensitive membrane with a plurality of depressible keys, each key representing a pre-programmed particular time that may be selected by pressing it's associated key. The indicator assembly is supported by the housing and includes at least one circular portion having a plurality of illuminatable regions which are presented thereon as spaced clock positions. Each position corresponds to a pre-programmed time and is illuminatable in response to the depression of a depressible key. The electronics assembly is contained within the housing and is in electrical communication with the keypad assembly and the indicator assembly. The alarm system is also supported by the housing and is a portion of the electronics assembly. The alarm system is activated upon reaching a pre-programmed particular time that has been selected by the depression of a depressible key.

10 Claims, 4 Drawing Sheets

FIG. 5
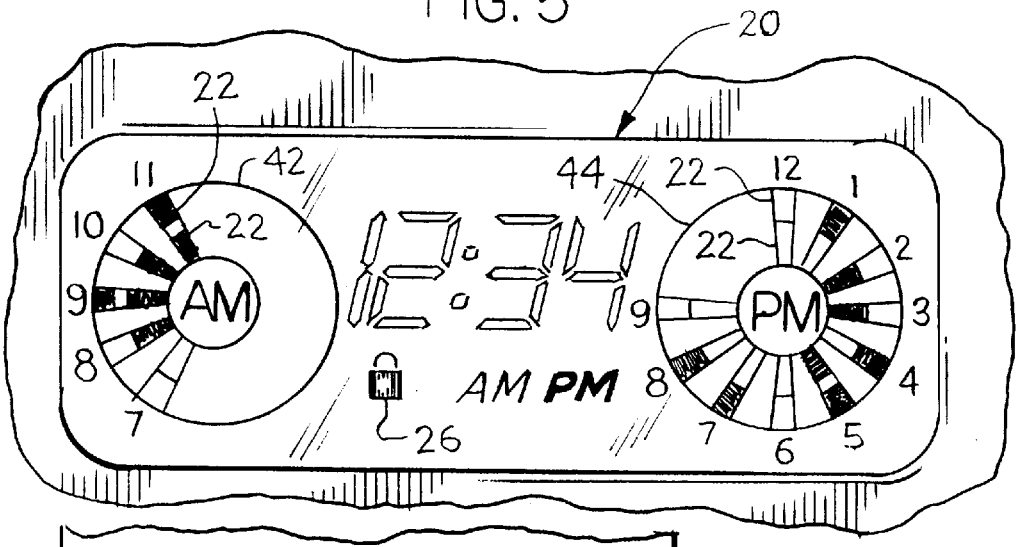
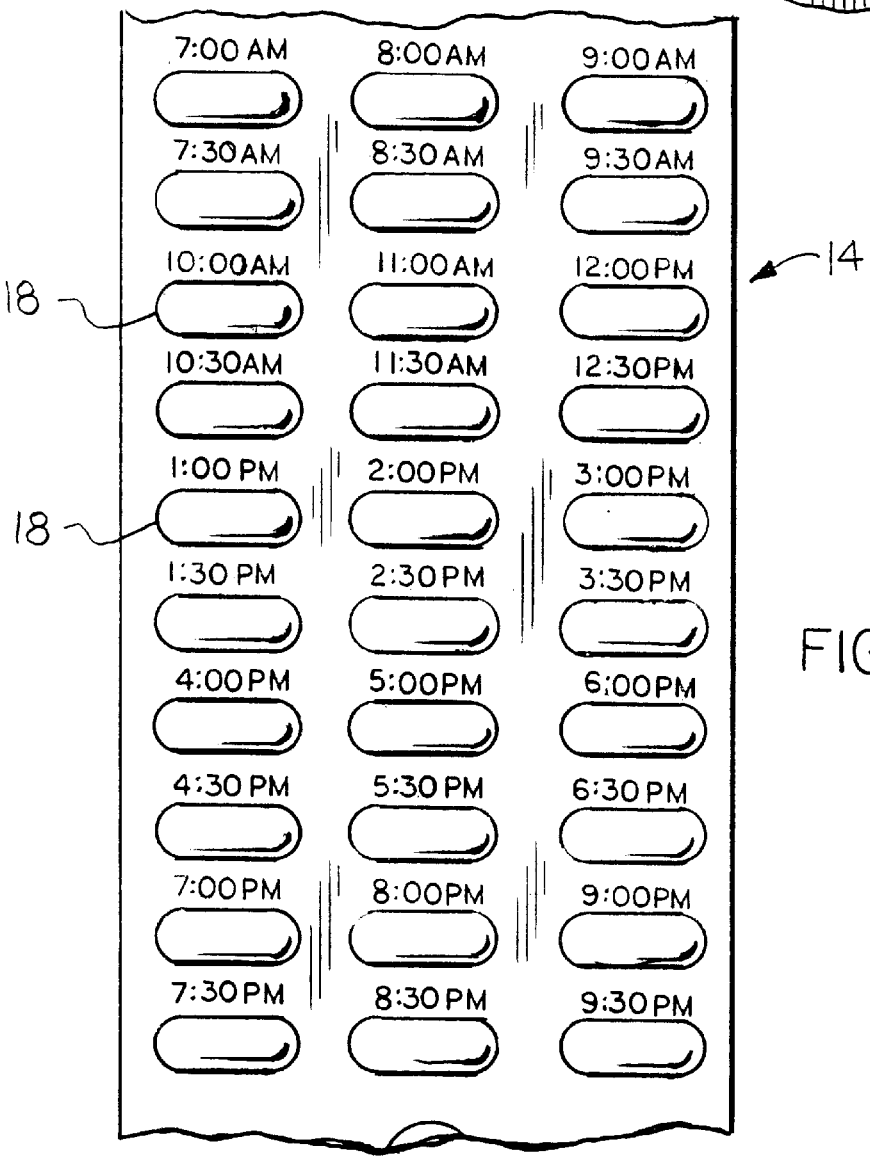
FIG. 6

APPOINTMENT TIMER

BACKGROUND OF THE INVENTION

1. Field of the Invention

The present invention relates to appointment timers and more particularly to a compact, thin electronic appointment timer which is particularly adapted for use with ringed notebooks and ringed binders.

2. Description of the Related Art

Users of ringed notebooks, including businesspersons and students, often desire to have an appointment timer at their disposal. However, appointment timers may be easily misplaced, especially while being transported, for example, between school, the home and/or the office. Present applicant, Mark A. Bedol, is the inventor of several devices that aid in preventing loss of articles that are often used by users of ringed notebooks and/or ringed binders.

Mr. Bedol is the inventor of the following:

U.S. Pat. No. 5,093,760 entitled, "Calculator having a Thin Resilient Clip Disposed About the Outer Periphery";

U.S. Pat. No. 5,058,736 entitled, "Notebook Organizer including Slidable Element";

U.S. Pat. No. 5,209,592 entitled, "Notebook Insert with Calculator and Holepunch";

U.S. Pat. No. 5,388,306 entitled, "Eraser for a Ring Binder";

U.S. Pat. No. DES. 369,178 entitled, "Notebook Calculator";

U.S. Pat. No. 5,553,958 entitled, "Combination Book and Holepunch Assembly";

U.S. Pat. No. 5,570,964 entitled, "Glue Stick Apparatus for a Ring Binder"; and

U.S. Pat. No. 5,409,319 entitled, "Notebook Insert with Holepunch."

Applicant is aware of an "appointment reminder" bearing the trademark Selectronics™, Model No. AR 119, distributed by Selectronics N.A., Inc. of Teterboro, N.J. However, it is deficient for potential use in a ringed notebook or ringed binder because it is too thick and, also, is too awkward to use. It uses a plurality of levers that, by their nature, cause the device to be relatively thick. Use of levers necessitates a rigid faceplate from which the levers protrude from. Use of a ridged faceplate, inturn additionally necessitates the use of a rigid housing on the sides and back. These various requirements result in a relatively thick device.

Another "appointment reminder" is distributed by Day-Timer®, Item No. AAF-50120. The Day-Timer device also uses levers and therefore suffers from the same deficiencies as the Selectronics™ device.

Heretofore, there has not been an appointment timer available which is easy to use and can be efficiently stored in a ringed notebook or binder.

OBJECTS AND SUMMARY OF THE INVENTION

It is therefore a principal object of the present invention to provide a thin appointment timer that can be easily incorporated with a user's organizer ensemble. In its broad aspects, the appointment timer of the present invention comprises a housing, a keypad assembly, an indicator assembly, an electronics assembly, and an alarm system. The keypad assembly is supported by the housing. The keypad assembly comprises a touch sensitive membrane with a plurality of depressible keys. Each key represents a pre-programmed particular time that may be selected by pressing it's associated key. The indicator assembly is supported by the housing and includes at least one circular portion having a plurality of illuminatable regions that are presented thereon as spaced clocked positions. Each position corresponds to a pre-programmed time and is illuminatable in response to the depression of a depressible key. The electronics assembly is contained within the housing and is in electrical communication with the keypad assembly and the indicator assembly. The alarm system is also supported by the housing and comprises a portion of the electronics assembly. The alarm system is activated upon reaching a pre-programmed particular time that has been selected by the depression of a depressible key.

In a first embodiment, the appointment timer includes a clip for attachment to paper. In another embodiment the invention includes spaced openings, which are adapted to engage the rings of a ringed notebook, or ringed binder.

Use of the present keypad assembly and indicator assembly, discussed above, allows the device to be made very thin and therefore it may be easily used with a binder, checkbook, wallet, etc. It is very inconspicuous.

The spaced clocked positions are preferably presented as two concentrically spaced sets of radially spaced clock positions, an inner set representing one-half hour increments and an outer set representing one-hour increments. This display allows the user to see all the alarm settings at one time within a cost efficient size and without the use of LED's on each alarm button on the keypad.

Other objects, advantages, and novel features will become apparent from the following detailed description of the invention when considered in conjunction with the accompanying drawings.

BRIEF DESCRIPTION OF THE DRAWINGS

FIG. 5 is an enlarged view of the indicator assembly of the present invention.

FIG. 6 is an enlarged view of the keypad assembly of the present invention.

The same reference characters designate the same parts or elements throughout the drawings.

DETAILED DESCRIPTION OF THE PREFERRED EMBODIMENTS

Figure 1:
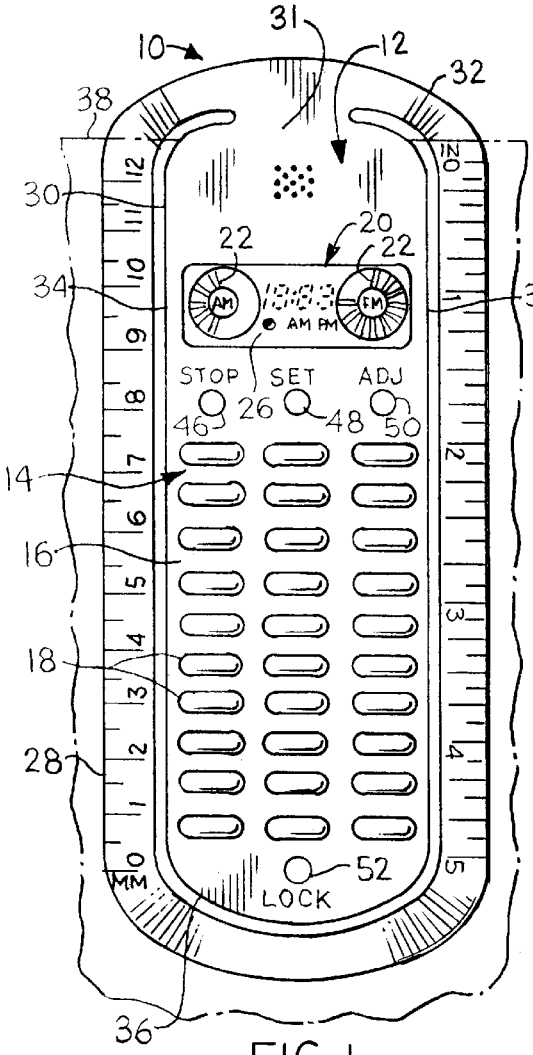
FIG. 1 is a front plan view of a first embodiment of the appointment timer of the present invention, which includes a clip for attachment to paper.
Figure 2:
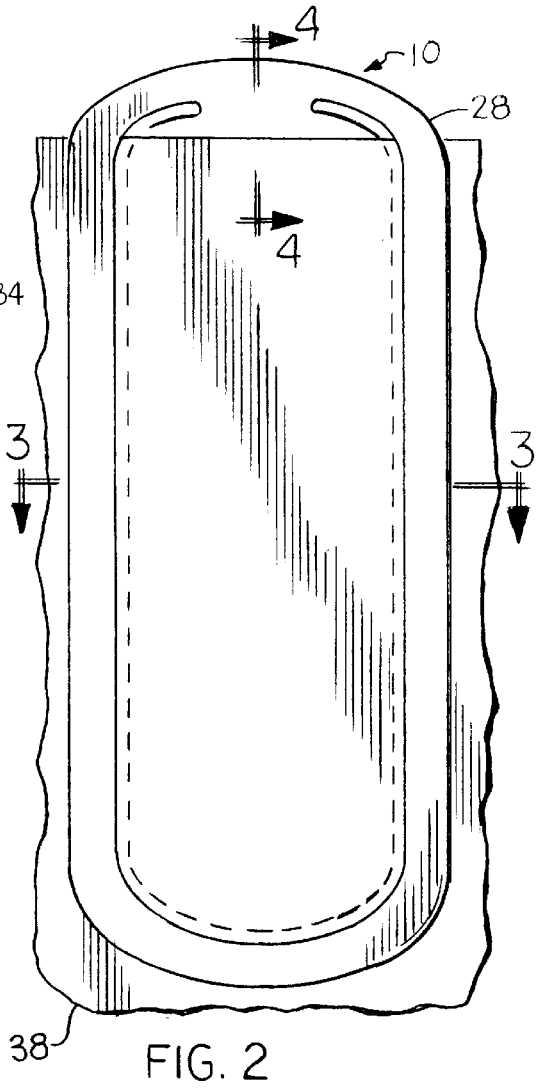
FIG. 2 is a rear plan view of the appointment timer of FIG. 1.
Figure 3:
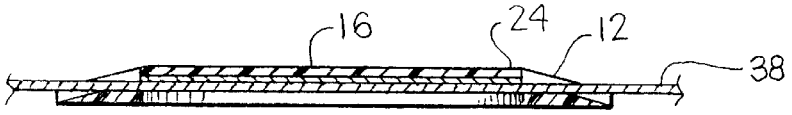
FIG. 3 is a view taken along Line 3—3 of FIG. 1.
Figure 4:
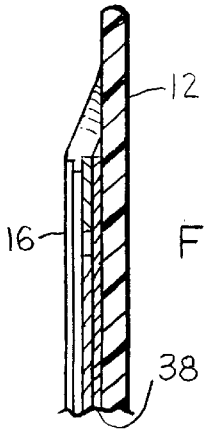
FIG. 4 is a view taken along Line 4—4 of FIG. 2.

Referring now to the drawings and the characters of reference marked thereon, FIGS. 1–7 illustrate a first embodiment of the appointment timer of the present invention, designated generally as 10. The appointment timer 10 includes a housing 12. A keypad assembly, designated generally as 14, is supported by the housing 12. The keypad assembly comprises a touch sensitive membrane 16 with a plurality of depressible keys 18. As will discussed below, each key represents a pre-programmed particular time that may be selected by pressing its associated key. The housing 12 supports an indicator assembly 20. The indicator assembly 20 includes a plurality of illuminatable regions 22. Each region 22 corresponds to a pre-programmed time and is illuminatable in response to the depression of a specific depressible key 18.

An electronics assembly 24 is contained within the housing. The electronics assembly 24 is in electrical communication with the keypad assembly 14 and the indicator assembly 20. An alarm system, indicated by icon 26 in FIG. 1, is activated upon reaching a pre-programmed particular time that has been selected by the depression of a depressible key 18.

A thin resilient clip 28 is disposed about the outer periphery 30 of the housing 12. In this preferred embodiment, the housing 12 and the resilient clip 28 are connected at an upper end 31 of the assembly 10, with the clip 28 forming a U-shape. Spaces 32 are formed adjacent the entirety of side edges 34 and bottom edge 36 of the housing 12, for allowing paper 38 or the like to be positioned between the outer periphery 30 and the resilient clip 28, thereby clipping the paper 38 to the appointment timer 10. The housing 12 and clip 28 are preferably a one-piece molded plastic unit, the clip 28 having approximately the same thickness as the housing 12. The edges of the front surface of the clip 28 are beveled to allow paper to curl around the clip easier and enable the housing 12 to sit flatter.

As shown in FIG. 1, the sheet of paper 38 is shown positioned or slid within the spaces 32 formed between the outer periphery 30 of the housing 12 and the resilient clip 28. The paper 38 curls slightly to allow the appointment timer 10 to maintain it's substantially planer alignment. At the same time, the clip is somewhat flexible to accommodate the paper in a similar manner as a paper clip. The clip 28 preferably includes straight outer side surfaces having spaced markings thereon for use as rulers.

Referring now to FIG. 5, the indicator assembly 20 is shown enlarged. The indicator assembly includes two circular portions 42, 44. The spaced clock positions are presented in the form of two concentrically spaced sets of radially spaced clock positions. The inner set represents half-hour increments and the outer set represents one-hour increments. The circular portion 42 represents "AM" and the second circular portion 44 represents "PM." Lighted portions represent the selected particular times. Use of these sets of concentrically spaced clock positions which are illuminatable provides very easy viewing analysis for the user.

The present time is also shown on the display, as well as an indication as to whether it is referring to AM or PM.

Referring now to FIG. 6, a portion of the keypad assembly 14 is illustrated. As can be seen in this figure, the depressible keys 18 comprise dedicated keys for preset times.

Figure 7:
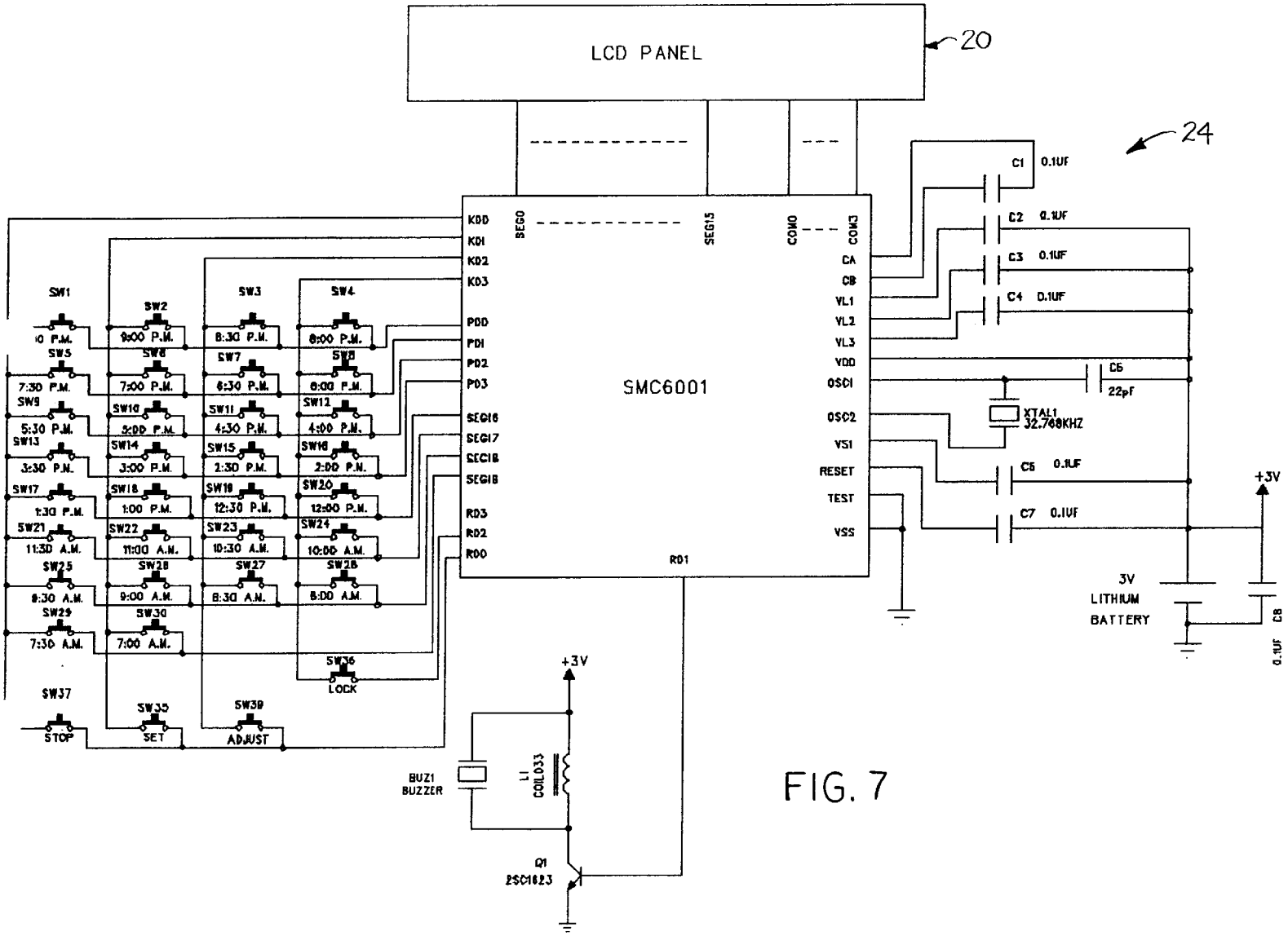
FIG. 7 is an electrical schematic of the electronics assembly of the present invention.

Referring now to FIG. 7, an electrical schematic is shown of the electronics assembly 24. As can be seen by this schematic, an example microprocessor chip that can be used for this invention is an Epson SMC6001. A 3-volt battery powers the unit.

In operation, the user can set up to 30 appointment reminders from 7:00 AM to 9:30 PM, at half-hour intervals. To select a reminder, the user simply depresses an associated key 18 to the time that is desired. When a reminder time is reached, the apparatus 10 will beep for three minutes until the stop button 46 is pressed. Further instructions are set forth below:

How to Reset

1. Turn the appointment timer 10 over and locate the RESET port.
2. Insert the unfolded tip of a paper clip (or similar object with a sharp tip) into the RESET port.

Setting the Time

1. To set the time press the "Set" key 48 once and the hour will blink.
2. Then press the "Adjust" key 50 to advance to the appropriate hour. The hour is now set.
3. To set the minutes press the "Set" key 48 once and the minutes will blink.
4. Press the "Adjust" key 50 to advance the minutes.
5. When finished setting the minutes press the "Set" key 48. (The AM or PM will appear under the minutes display).

Setting the Alarm—The alarm can be set to chime on the hour or half-hour.

1. Press the key, which shows the time you wish the alarm to chime. The alarm chimes once indicating the alarm was successfully set. The corresponding alarm mark will appear on the display.
   Note: a). Outer circle mark—Hourly time unit. b). Inner circle mark—Half hour time unit.

Stopping and Turning off the Alarm

1. When alarm chimes at the time that has been selected press the "Stop" key 46 to stop the chime.
2. When the alarm is stopped the black dot will blink next to the hour until midnight, this indicates that the alarm will automatically reset to the same time on the following day if it is not turned off.
3. To turn the alarm off so that it does not chime on the following day press the time at which it was originally set.

Locking Feature—The locking feature was designed to prevent accidentally changing the time or alarm.

1. To set locking feature press the "Lock" key 52, and a lock symbol 26 will appear on the screen. (When the locking feature is on, no key can be pressed to alter the time or alarm until the locking is removed.)
2. To turn off the lock press the "Lock" key 52. The lock symbol 26 will disappear, indicating that the locking feature has been turned off.

Viewing Attended Appointments

1. Press and hold the "Adjust" key 5. The display will show the number of appointments or number of times the alarm has chimed that day. The counter will be cleared at midnight everyday.

Changing the Battery

1. When the display appears dim it is time to change the battery (e.g. CR 2025).
2. Remove the screw, back panel and old battery.
3. Place the new battery in with positive (+) side facing up.
4. Replace back panel and screw.

Figure 8:
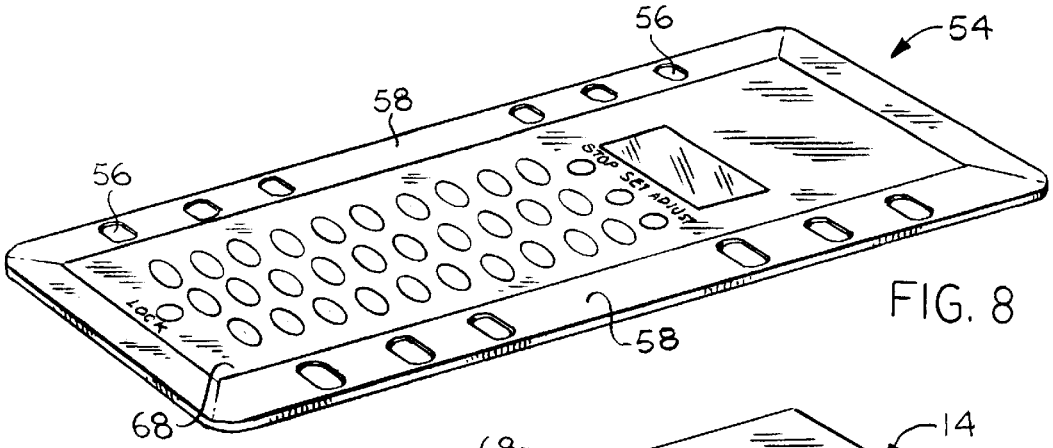
FIG. 8 is a perspective view of a second embodiment of the present invention which includes spaced openings adapted to engage the rings of a ringed notebook or ringed binder.

Referring now to FIG. 8, a second embodiment of the present invention is illustrated designated generally as 54. This embodiment, instead of using a clip, has a plurality of spaced openings 56 through peripheral edges 58 thereof. The openings 56 are so sized and spaced as to be accommodated by the rings of a ringed notebook or ringed binder.

Figure 9:
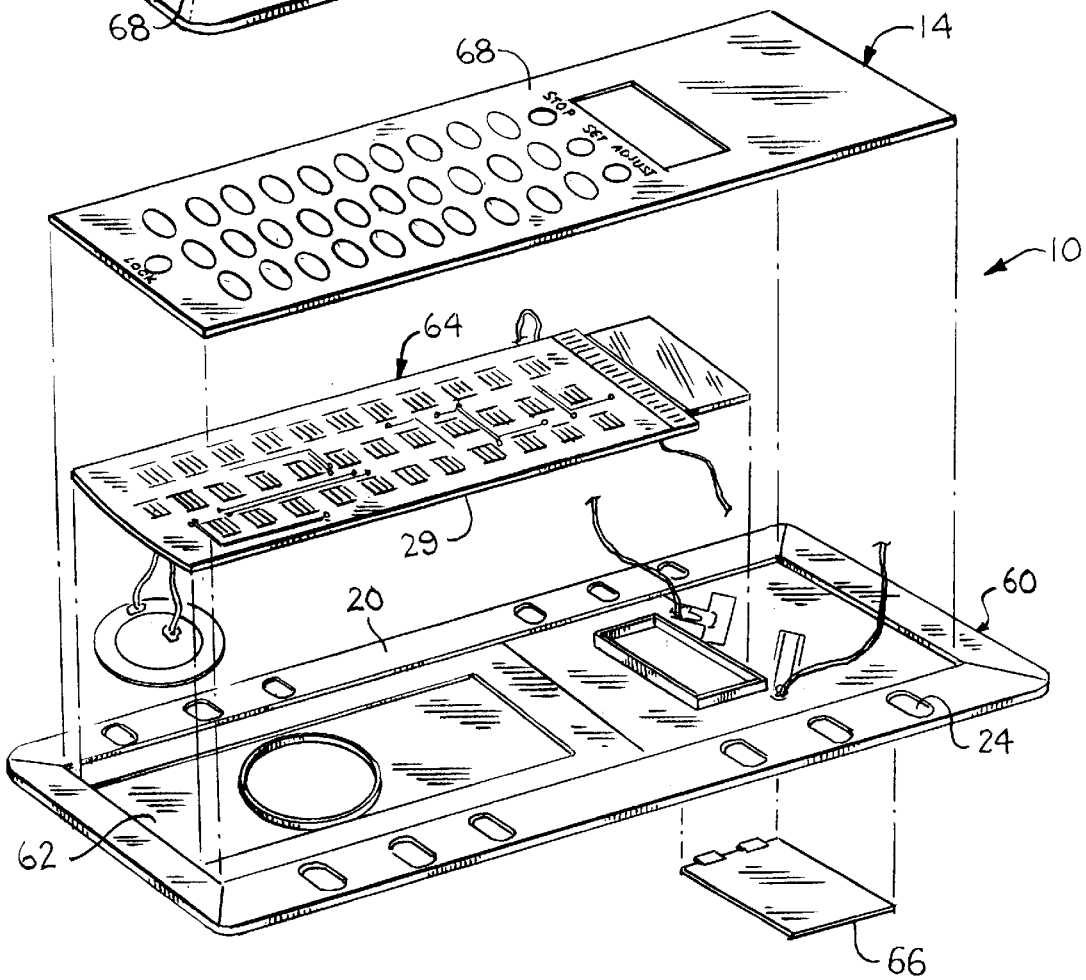

Referring now to FIG. 9, an exploded view of this embodiment is illustrated. As can be seen in this figure, a main portion of the housing 60 has a recess 62 formed therein for containing the electronics or PCB assembly 64. The housing 60 is preferably formed of rigid ABS plastic. The keypad assembly 68 is formed of a thin membrane-type material. It may be, for example, on the order of about 0.3 mm thick. The PCB assembly 64 may be, for example, on the order of about 0.6 mm thick. A battery door 66 provides access for the batteries, not shown.

It is noted that the above discussion regarding FIG. 9 applies equally to the first embodiment, the basic components being the same.

Obviously, many modifications and variations of the present invention are possible in light of the above teachings. For example, although the invention has been shown as having two embodiments, it is understood that various combinations may be provided, for example, the first embodiment (apparatus 10) may be provided with spaced openings on the clip portion so as to provide similar functions as that of the second embodiment. It is, therefore, to be understood that within the scope of the appended claims, the invention may be practiced otherwise than as specifically described.

What is claimed and desired to be secured by Letters Patent of the United States is:

1. An appointment timer, comprising:

a) a housing;

b) a keypad assembly, supported by said housing, comprising a touch sensitive membrane with a plurality of depressable keys, each key representing a pre-programmed particular time which may be selected by pressing its associated key;

c) an indicator assembly, supported by said housing, including at least one circular portion having a plurality of illuminatable regions which are presented thereon as spaced clock positions, each position corresponding to a pre-programmed time and being illuminatable in response to the depression of a depressable key;

d) an electronics assembly, contained within said housing, in electrical communication with said keypad assembly and said indicator assembly; and e) an alarm system supported by said housing, comprising a portion of said electronics assembly, which is activated upon reaching a pre-programmed particular time that has been selected by the depression of a depressable key.

2. The appointment timer of claim 1, wherein said keypad assembly comprises a pushbutton keypad.

3. The appointment timer of claim 1, wherein said plurality of spaced clock positions are presented in the form of two concentrically spaced sets of radially spaced clock positions, an inner set representing one-half hour increments and an outer set representing one hour increments.

4. The appointment timer of claim 1, wherein said indicator assembly comprises a first circular portion and a second circular portion, said first circular portion representing "AM" and said second circular portion representing "PM."

5. The appointment timer of claim 1, wherein said housing comprises a plurality of spaced openings through a peripheral edge thereof, being so sized and arranged as to be accommodated by the rings of a ringed notebook or ringed binder.

6. The appointment timer of claim 1, wherein said plurality of depressible keys comprises dedicated keys for preset times.

7. The appointment timer of claim 1, further including a thin resilient clip disposed about the outer periphery of said housing, said clip being integrally connected to a portion of said housing, spaces formed between said outer periphery and said resilient clip for allowing paper or the like to be positioned between said outer periphery and said resilient clip, thereby allowing clipping of paper or the like to said housing.

8. The appointment timer of claim 7, wherein said housing and said resilient clip are connected at an upper end of said housing, said spaces being formed adjacent side edges and a lower edge of said housing, allowing paper or the like to be positioned between said housing and said resilient clip.

9. The appointment timer of claim 8, wherein said resilient clip is substantially U-shaped.

10. The appointment timer of claim 1, wherein said alarm system comprises a "lock" to prevent inadvertent changing of alarm settings.

* * * * *